US007476186B1

(12) United States Patent
Steffee

(10) Patent No.: US 7,476,186 B1
(45) Date of Patent: Jan. 13, 2009

(54) EXERCISE APPARATUS WITH PLATFORM ADJUSTMENT MECHANISM

(75) Inventor: Clay J. Steffee, Alexandria, KY (US)

(73) Assignee: Brunswick Corporation, Lake Forest, IL (US)

( * ) Notice: Subject to any disclaimer, the term of this patent is extended or adjusted under 35 U.S.C. 154(b) by 37 days.

(21) Appl. No.: 11/677,628

(22) Filed: Feb. 22, 2007

(51) Int. Cl.
*A63B 21/00* (2006.01)

(52) U.S. Cl. ..... 482/137; 482/145; 482/908; 108/144.11

(58) Field of Classification Search ..... 482/100, 482/123, 135, 136; 108/108, 144.11, 146, 108/147.11, 147.16, 147.17; 211/126.5, 211/133.3, 173, 174; 248/125.1, 157, 161
See application file for complete search history.

(56) References Cited

U.S. PATENT DOCUMENTS

| | | | | | |
|---|---|---|---|---|---|
| 300,887 | A | * | 6/1884 | Owen | 182/149 |
| 324,602 | A | * | 8/1885 | Solliday | 108/147.11 |
| 730,894 | A | * | 6/1903 | Fairbanks et al. | 33/10 |
| 775,496 | A | * | 11/1904 | Parsons | 108/106 |
| 806,485 | A | * | 12/1905 | Parker | 108/63 |
| 1,063,766 | A | * | 6/1913 | Becker | 33/10 |
| 2,468,856 | A | * | 5/1949 | Alexander | 312/241 |
| 3,128,074 | A | * | 4/1964 | Schwarz | 248/246 |
| 3,638,584 | A | * | 2/1972 | Cisler et al. | 108/6 |
| 3,640,527 | A | * | 2/1972 | Proctor | 482/100 |
| 4,026,222 | A | * | 5/1977 | Mueller | 108/146 |
| 4,231,301 | A | * | 11/1980 | Barrineau, III | 108/146 |
| 4,292,902 | A | * | 10/1981 | Barrineau | 108/146 |
| 4,383,486 | A | * | 5/1983 | Reineman et al. | 108/2 |
| 4,470,596 | A | * | 9/1984 | Desiderio | 482/98 |
| 4,565,368 | A | * | 1/1986 | Boettcher | 482/134 |
| 4,627,616 | A | * | 12/1986 | Kauffman | 482/96 |
| 4,702,108 | A | * | 10/1987 | Amundsen et al. | 73/379.01 |
| 4,711,448 | A | * | 12/1987 | Minkow et al. | 482/100 |
| 4,795,149 | A | * | 1/1989 | Pearson | 482/98 |
| 5,039,054 | A | * | 8/1991 | Pai | 248/423 |
| 5,050,868 | A | * | 9/1991 | Pearson | 482/94 |
| 5,308,304 | A | * | 5/1994 | Habing | 482/99 |
| 5,354,252 | A | * | 10/1994 | Habing | 482/100 |
| 5,365,860 | A | * | 11/1994 | Billington, III | 108/108 |
| 5,410,971 | A | * | 5/1995 | Golden et al. | 108/6 |
| 5,468,202 | A | * | 11/1995 | Habing | 482/100 |
| 5,483,902 | A | * | 1/1996 | Grosch | 108/143 |
| 5,492,518 | A | * | 2/1996 | Measom | 482/96 |
| 5,554,085 | A | * | 9/1996 | Dalebout | 482/137 |
| 5,695,078 | A | * | 12/1997 | Otema | 211/103 |
| 5,711,749 | A | * | 1/1998 | Miller | 482/135 |
| 5,718,406 | A | * | 2/1998 | Long | 248/600 |
| 5,735,222 | A | * | 4/1998 | Webb | 108/144.11 |
| 5,813,951 | A | * | 9/1998 | Einsig | 482/97 |
| 6,036,624 | A | * | 3/2000 | Cascini | 482/97 |

(Continued)

*Primary Examiner*—Loan H Thanh
*Assistant Examiner*—Daniel F Roland
(74) *Attorney, Agent, or Firm*—Andrus, Sceales, Starke & Sawall, LLP

(57) ABSTRACT

Exercise apparatus for resistance training includes an adjustment mechanism raising and lowering a platform, e.g. a stand-upon platform supporting the feet of the user. The adjustment mechanism both: a) journals the platform to pivot about a pivot axis parallel to a first lateral axis into and out of engagement with a detent lock; and b) linearly guides translational up and down movement of the platform and prevents side to side canting of the platform about a second lateral axis.

5 Claims, 8 Drawing Sheets

U.S. PATENT DOCUMENTS 6,205,934 B1 * 3/2001 Felton et al. ..... 108/107
6,283,898 B1 * 9/2001 Polidi ..... 482/104
6,319,177 B1 * 11/2001 Levine ..... 482/100
6,378,446 B1 * 4/2002 Long ..... 108/147
6,402,633 B1 * 6/2002 Hsiung et al. ..... 473/219
6,540,093 B1 * 4/2003 Shumway ..... 211/90.02
6,584,916 B1 * 7/2003 Felton et al. ..... 108/107
6,623,409 B1 * 9/2003 Abelbeck ..... 482/104
6,675,725 B2 * 1/2004 Felton et al. ..... 108/107
6,962,116 B2 * 11/2005 Bienick et al. ..... 108/108
6,966,267 B2 * 11/2005 Bienick ..... 108/108
7,093,691 B1 * 8/2006 Vaughan et al. ..... 187/269
7,337,730 B2 * 3/2008 Bienick et al. ..... 108/108
2005/0066861 A1 * 3/2005 DeBraal et al. ..... 108/147
2005/0274299 A1 * 12/2005 Bienick et al. ..... 108/108
2006/0252609 A1 * 11/2006 Abelbeck ..... 482/92
2007/0042876 A1 * 2/2007 Lundquist ..... 482/94
2008/0017776 A1 * 1/2008 Wang ..... 248/448

* cited by examiner

EXERCISE APPARATUS WITH PLATFORM ADJUSTMENT MECHANISM

BACKGROUND AND SUMMARY

The invention relates to exercise apparatus for resistance training.

Various types of exercise apparatus for resistance training include a platform supporting the user, e.g. a stand-upon platform supporting the feet of the user, for a hip flexor or hip glute machine, and so on. The platform is adjustable up and down, to accommodate different height users. One known type of platform adjustment mechanism uses a peg-in-hole type lock.

The present system provides a simple and effective platform adjustment mechanism for resistance training exercise apparatus.

DETAILED DESCRIPTION

Figure 1:
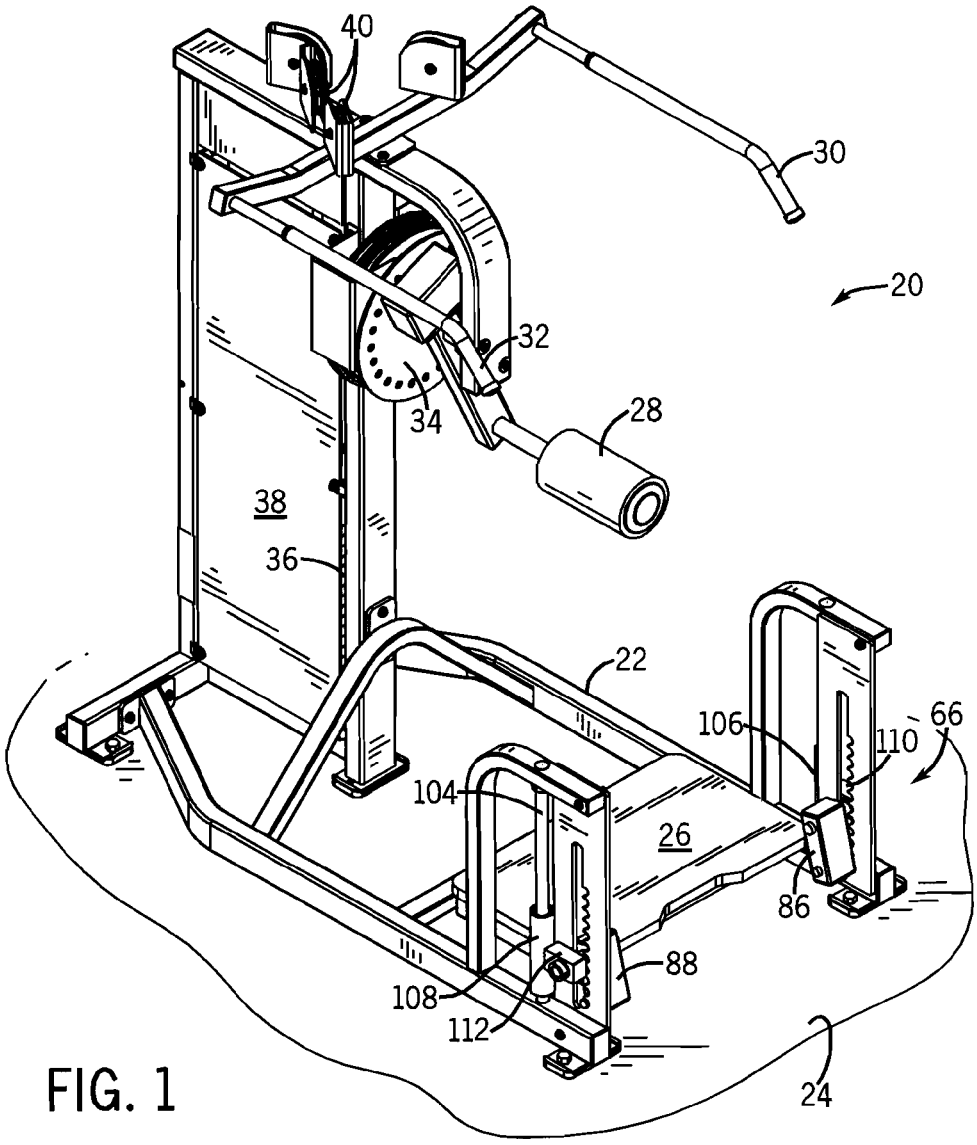
FIG. 1 is a perspective view of exercise apparatus for resistance training in accordance with the invention.

FIG. 1 shows exercise apparatus 20 for resistance training, including a frame 22 resting on a floor 24 and supporting a laterally extending platform 26 at a plurality of vertical elevations, to be described. Platform 26 supports and locates a user for resistance training, e.g. a hip flexor or hip glute routine wherein the user extends one leg over pad 28, while holding onto handlebar 30 and/or 32, and swings leg/knee pad 28 in an arc to rotate pulley 34 to in turn lift one or more weights in weight stack 36 (partially hidden by shield plate 38) via pulley cable system 40, all as is known. Platform 26 supports and locates the user for such resistance training, e.g. supporting one leg and foot of the user, while the other leg is extended over and partially around pad 28.

Figure 2:
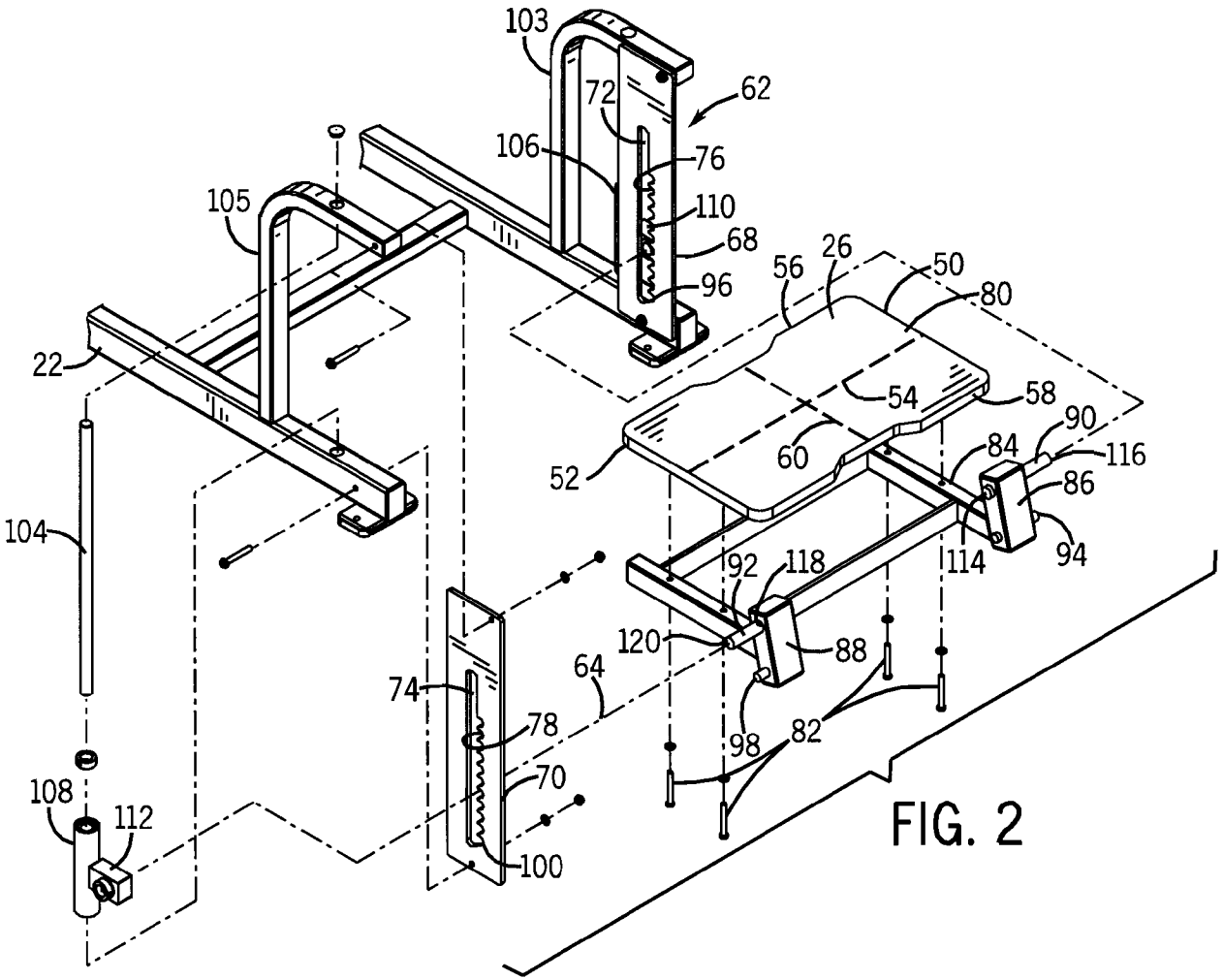
FIG. 2 is an exploded perspective view of a portion of FIG. 1.
Figure 3:
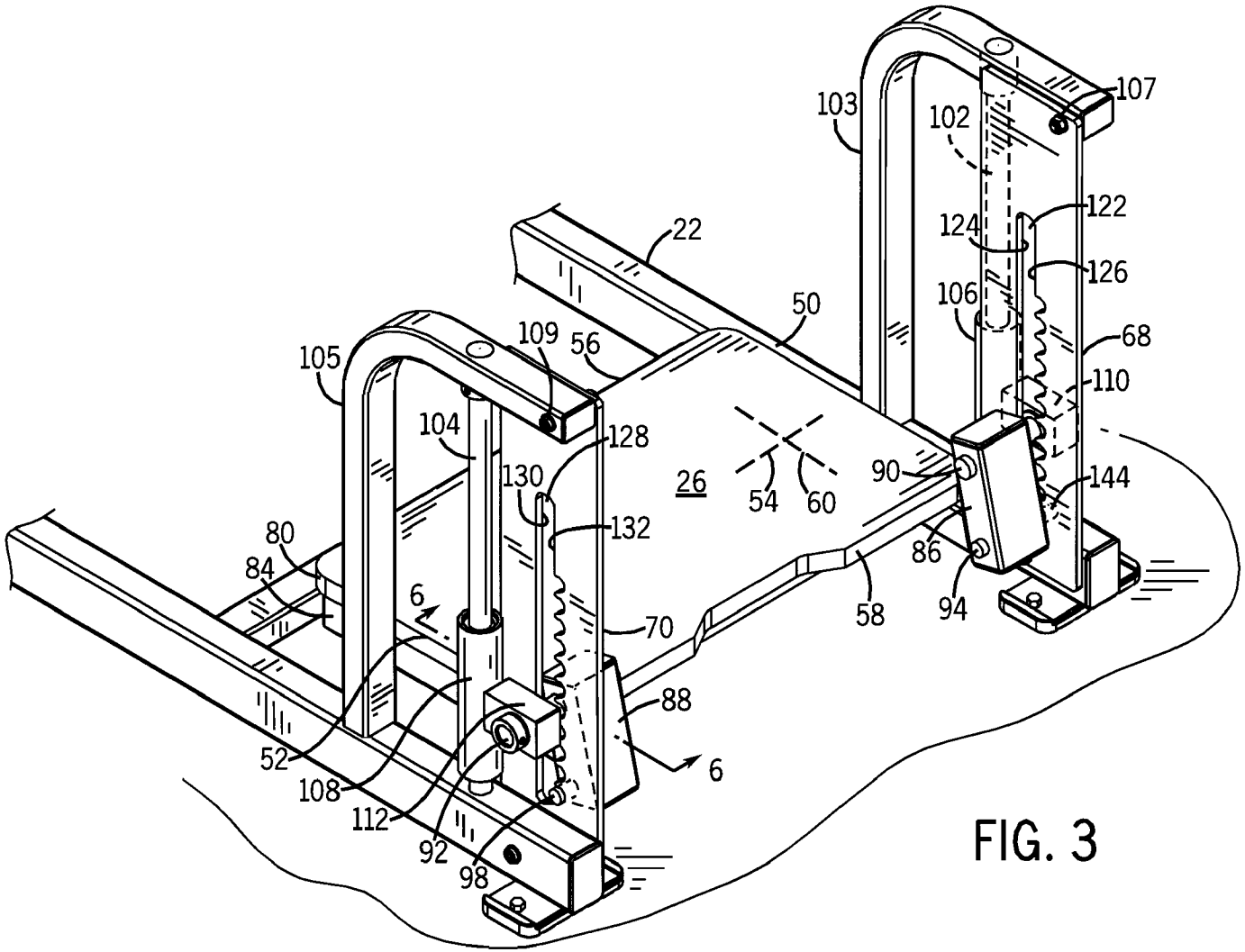
FIG. 3 is an enlarged perspective view of a portion of FIG. 1.
Figure 4:
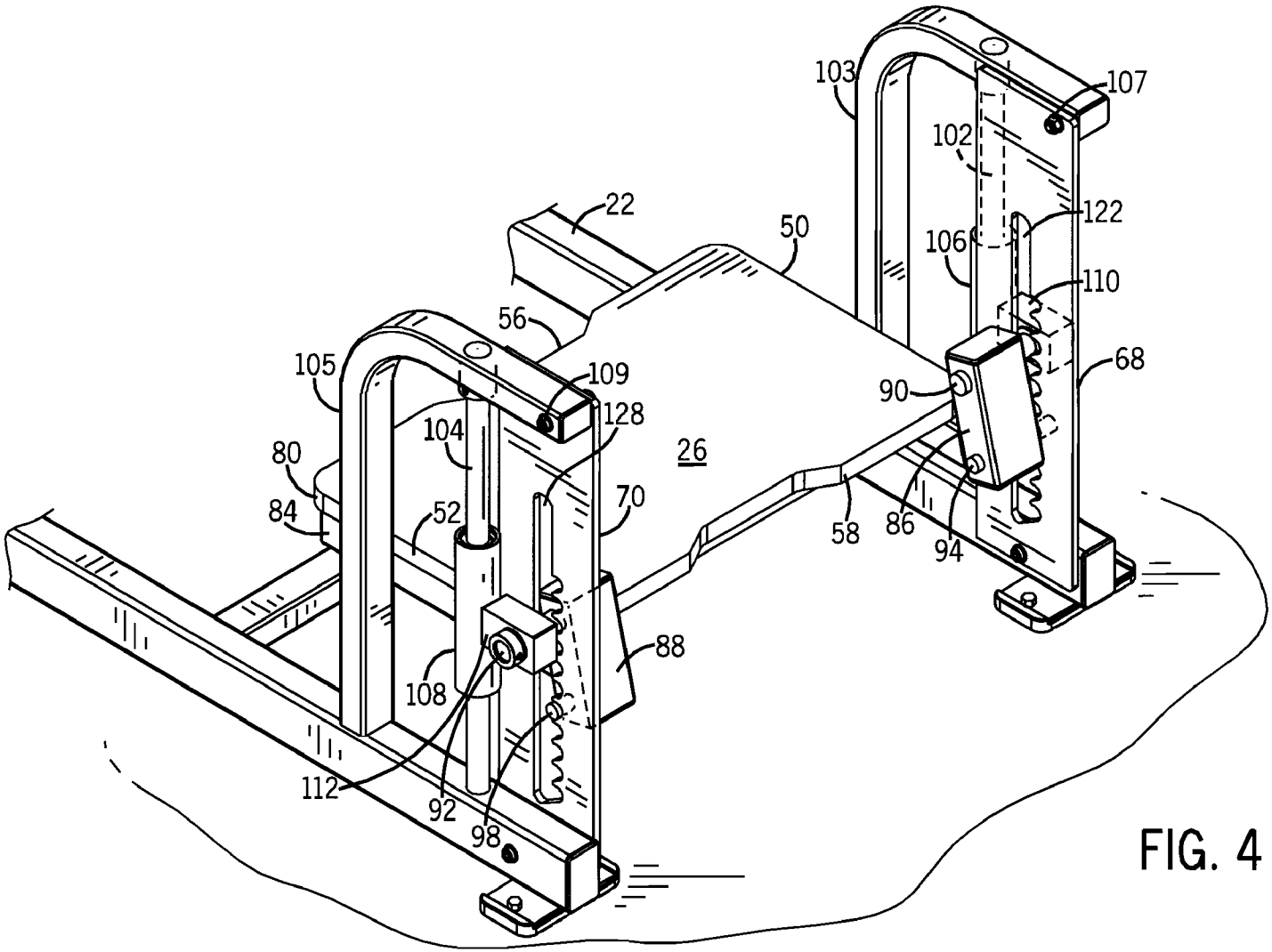
FIG. 4 is like FIG. 3 and shows an alternate position of the platform.
Figure 5:
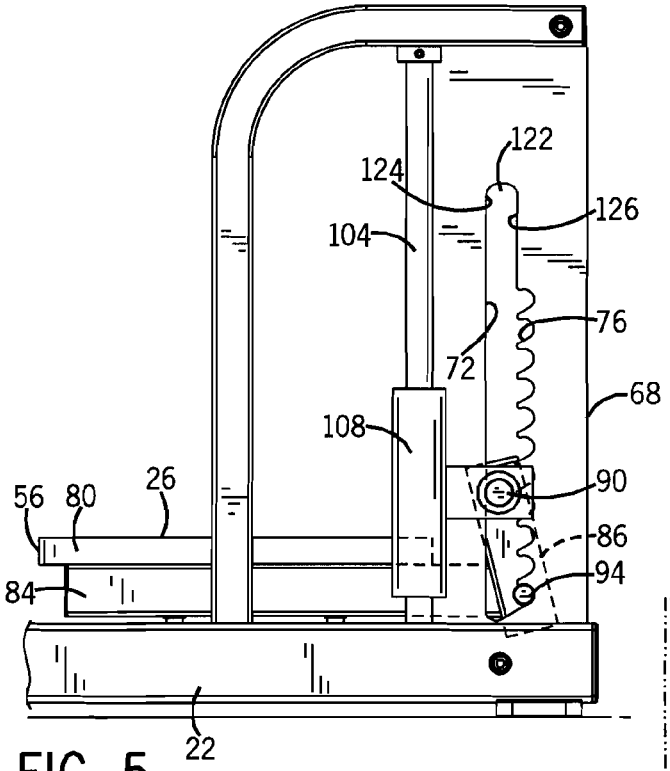
FIG. 5 is a side elevation view of the structure of FIG. 3.
Figure 6:
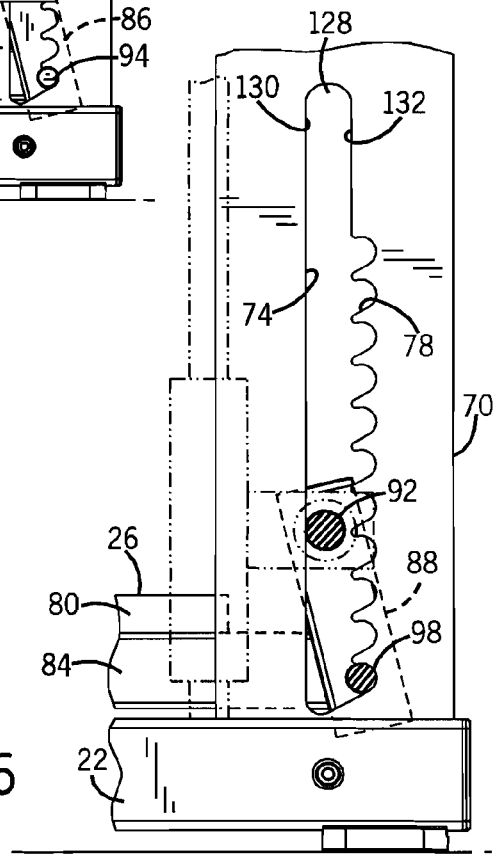
FIG. 6 is a sectional view taken along line 6-6 of FIG. 3.
Figure 7:
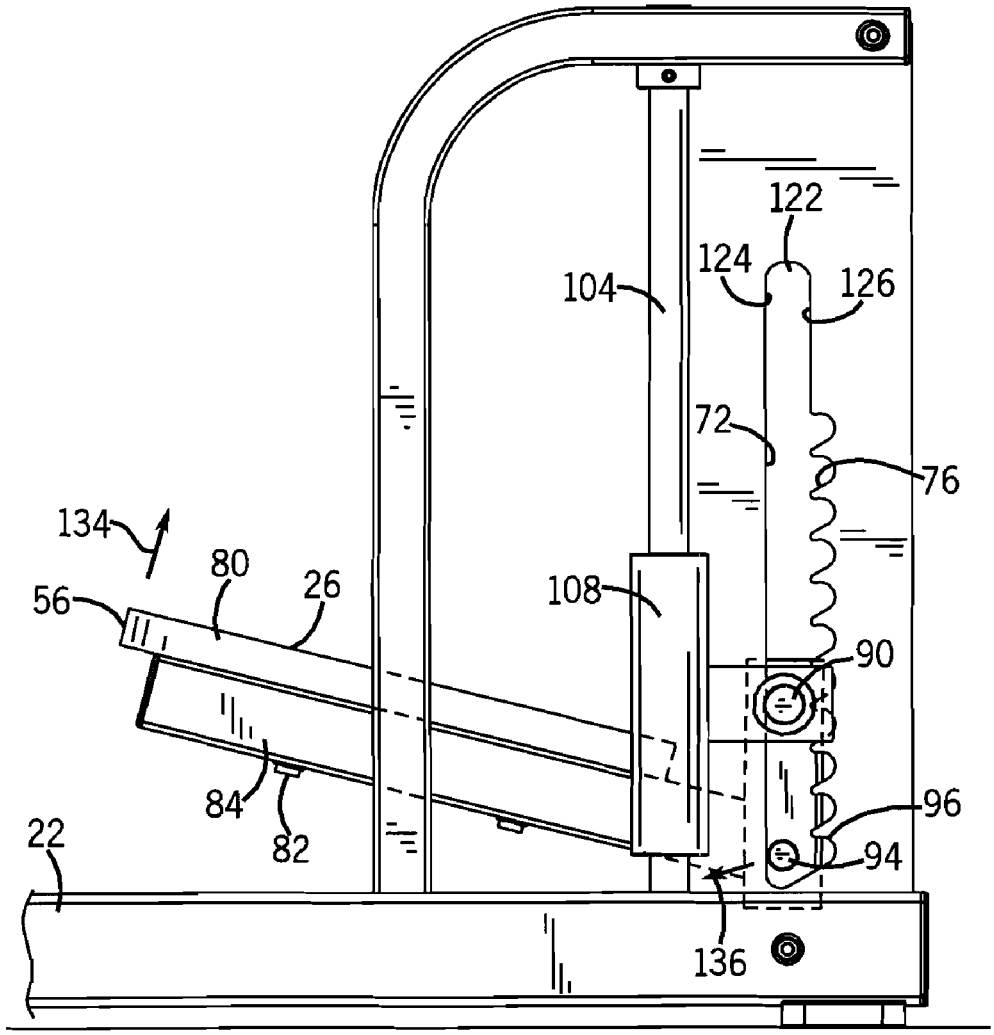
FIG. 7 is like FIG. 5 and illustrates operation of the platform during a height change.
Figure 8:
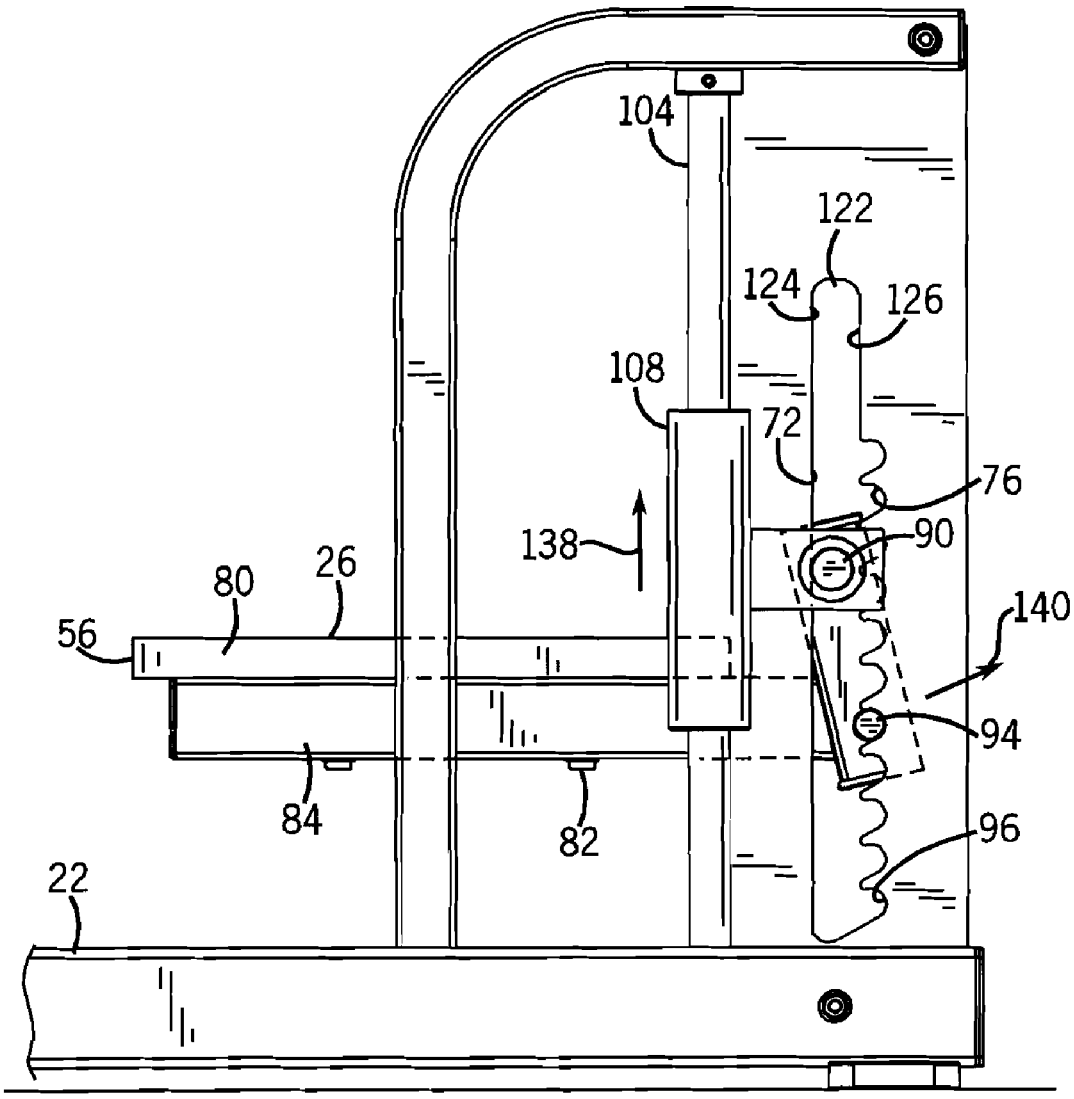
FIG. 8 is like FIG. 7 and shows completion of a height adjustment to a new vertical elevation.

Platform 26, FIGS. 1-3, has distally opposite first and second sides 50 and 52 laterally spaced along a first lateral axis 54. The platform has distally opposite third and fourth sides 56 and 58 laterally spaced along a second lateral axis 60. Lateral axes 54 and 60 are normal to each other. An adjustment mechanism 62 is provided for raising and lowering platform 26 to a plurality of vertical elevations. The adjustment mechanism both: a) journals platform 26 to pivot about a pivot axis 64 parallel to first lateral axis 54 into and out of engagement with a detent lock 66, to be described, such that platform 26 is locked in place at a given vertical elevation when pivoted into engagement with the detent lock, and the platform may move up and down when pivoted out of engagement with the detent lock; and b) linearly guides translational movement of platform 26 during the noted up and down movement of the platform and prevents side to side canting of the platform about second lateral axis 60 during the noted up and down movement of the platform and preventing misalignment of first and second sides 50 and 52 of the platform.

Adjustment mechanism 62 includes first and second stanchions 68 and 70 extending upwardly from frame 22. Each stanchion has a respective track 72 and 74 extending upwardly and downwardly therealong, and a respective tooth rack 76 and 78 extending upwardly and downwardly therealong. Platform 26 includes a floorboard 80 mounted by bolts 82 to a carriage 84 having first and second bearing blocks 86 and 88 pivotable about and translational along respective stanchions 68 and 70. Tooth racks 76, 78 provide the noted detent lock, to be further described.

First bearing block 86 has a horizontal first main shaft 90, FIGS. 2, 3, translational along track 72 of stanchion 68, FIGS. 5-8, and moving upwardly and downwardly therealong during up and down movement of platform 26. Second bearing block 88 has a horizontal second main shaft 92 translational along track 74 of stanchion 70 and moving upwardly and downwardly therealong during up and down movement of platform 26. Horizontal first and second main shafts 90 and 92 are coaxial. Platform 26 is pivoted between a first locked position, FIGS. 1, 3-6, 8, and a second unlocked position, FIG. 7, by swinging the noted third side 56 of platform 26 upwardly and downwardly, FIGS. 7, 8, to pivot platform 26 about the coaxial horizontal main shafts 90 and 92. First bearing block 86 has a horizontal first auxiliary shaft 94, FIGS. 2, 3, engaging a given first tooth 96 in tooth rack 76 of stanchion 68 in the noted first pivoted locked position of platform 26 to lock the platform at a given one of the noted vertical elevations corresponding to tooth 96. Horizontal first auxiliary shaft 94 disengages tooth rack 76 of stanchion 68 in the noted second pivoted unlocked position of platform 26 to, unlock the platform and permit upward and downward movement thereof, FIG. 7. Second bearing block 88 has a horizontal second auxiliary shaft 98, FIGS. 2, 3, engaging a given second tooth 100 in tooth rack 78 of stanchion 70, corresponding to tooth 96, in the noted first pivoted locked position of platform 26 to lock the platform at the noted given one of the vertical elevations corresponding to teeth 100 and 96. Horizontal second auxiliary shaft 98 disengages tooth rack 78 in the noted second pivoted unlocked position of platform 26, FIG. 7, to unlock the platform and permit upward and downward movement thereof. Horizontal first and second main shafts 90 and 92 engage tracks 72 and 74 of first and second stanchions 68 and 70, respectively, at each of the vertical elevations along the stanchions at respective vertically spaced teeth of the respective tooth racks, and during at least a portion of travel of the platform during the up and down movement thereof.

Adjustment mechanism 66 further includes first and second guide rods 102 and 104, FIGS. 1-3, extending upwardly from frame 22 adjacent first and second stanchions 68 and 70, respectively. The adjustment mechanism further includes first and second linear bearing assemblies 106 and 108 slidable upwardly and downwardly along respective first and second guide rods 102 and 104 and operatively connected to respective first and second bearing blocks 86 and 88 to guide translational up and down movement of first and second bearing blocks 86 and 88 and prevent canting of platform 26 about the noted second lateral axis 60. First and second linear bearing assemblies 106 and 108 have respective first and second bearing sub-blocks 110 and 112 laterally adjacent respective first and second stanchions 68 and 70. Horizontal first main shaft 90 has a first end 114 mounted to first bearing block 86, and has a second end 116 mounted to first bearing sub-block 110. Horizontal second main shaft 92 has a first end 118 mounted to second bearing block 88, and has a second end 120 mounted to second bearing sub-block 112. First stanchion 68 is disposed laterally between first bearing block 86 and first bearing sub-block 110. Second stanchion 70 is disposed laterally between second bearing block 88 and second bearing sub-block 112. Guide rods 102 and 104 extend upwardly to upper ends which are mounted to support arms 103 and 105 of the frame to rigidly locate and anchor guide rods 102 and 104. Support arms 103 and 105 extend upwardly from the frame and then curve laterally and are bolted to respective stanchions 68 and 70 at respective bolts 107 and 109.

First stanchion 68 has a first slot 122 formed laterally therethrough, which slot is elongated upwardly and downwardly along first stanchion 68 and has opposing elongated inner sides 124 and 126 facing each other across such slot. Inner side 124 provides the noted track 72 of first stanchion 68, and inner side 126 provides the noted tooth rack 76 of first stanchion 68. Horizontal first main shaft 90 extends laterally through first slot 122. Second stanchion 70 has a second slot 128 formed laterally therethrough, which slot is elongated upwardly and downwardly along second stanchion 70 and has opposing elongated inner sides 130 and 132 facing each other across slot 128. Inner side 130 of second slot 128 provides the noted track 74 of second stanchion 70, and inner side 132 of second slot 128 provides the noted tooth rack 78 of second stanchion 70. Horizontal second main shaft 92 extends laterally through second slot 128.

In the disclosed embodiment, platform 26 is a stand-upon platform supporting the feet of the user, though other types of support platforms may be used. Platform 26 is a cantilever having a root end at fourth side 58, and a free end at third side 56. The user grips the platform at third and fourth sides 56 and 58, and then tilts third side 56 upwardly, as shown at arrow 134 in FIG. 7, to move auxiliary shafts 94 and 98 out of engagement with respective teeth, as shown at arrow 136, and then the platform is translated upwardly as guided by linear bearing assemblies 106 and 108 along guide rods 102 and 104, as shown at arrow 138 in FIG. 8, whereafter third side 56 of the platform is tilted downwardly to in turn move auxiliary shafts 94 and 98 into engagement with respective teeth of respective tooth racks, as shown at arrow 140 in FIG. 8.

Figure 9:
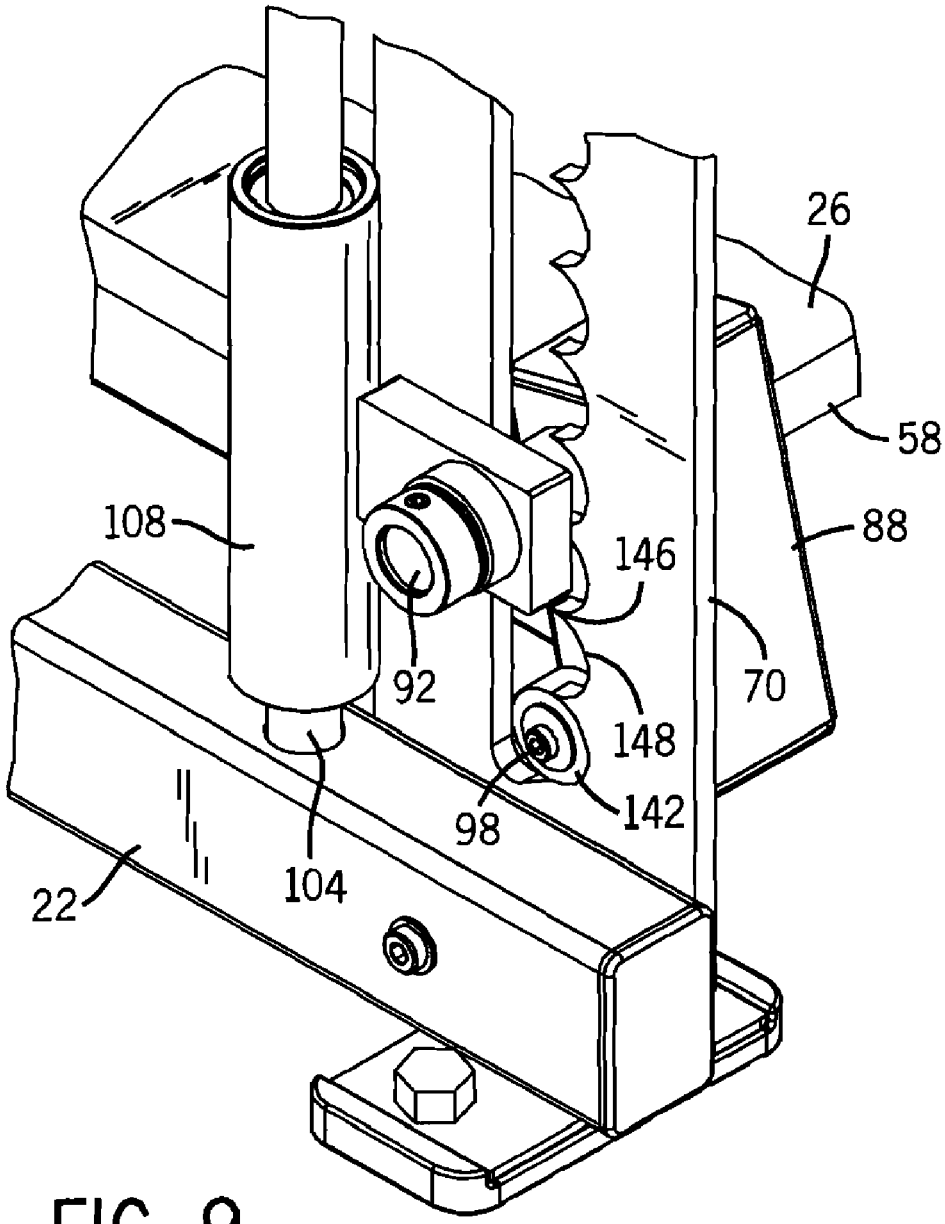
FIG. 9 is an enlarged view of a portion of FIG. 3, and shows a further embodiment.

In a further and preferred embodiment, FIG. 9, horizontal auxiliary shaft 98 of FIG. 3 includes a cam follower 142 journaled thereto. Horizontal first auxiliary shaft 98 engages tooth rack 78 and its teeth of stanchion 70 at cam follower 142. Horizontal auxiliary shaft 94 also includes a cam follower as shown in dashed line at 144 in FIG. 3, journaled thereto, and horizontal auxiliary shaft 94 engages tooth rack 76 and its teeth of stanchion 68 at cam follower 144. The cam followers may be desirable to reduce the chance of a "false lock" and to make adjustment easier. False lock could possibly occur if a shaft such as 98 catches on the point of the tooth increment, e.g. 146, instead of settling into a tooth or concavity such as 148. This causes platform 26 to be at rest at an angle, and in a position that can be easily bumped, causing the platform to release and fall. Furthermore, when a user lifts platform side 56, shafts 98 and 94 may contact the respective inner sides 130 and 124 of slots 128 and 122 of tracks 74 and 72, which contact of shafts 98 and 94 against sides 130 and 124 can result in excessive friction, making the platform harder to lift. The addition of the cam followers 142 and 144 on the outer ends of the shafts eliminate these potential problems, and provide easier adjustment. Tooth racks 78 and 76 are modified to fit the diameter of the respective cam follower 142 and 144 which is larger than the diameter of the respective shaft 98 and 94. When side 56 of the platform is lifted, cam followers 142 and 144 can come into contact with inner sides 130 and 124 of the respective slots and roll therealong, resulting in easier raising and lowering of the platform. The teeth of tooth racks 78 and 76 may thus be engaged directly by respective shafts 98 and 94 as in FIGS. 1-8, or may be engaged through respective cam followers 142 and 144 as in FIG. 9.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. Exercise apparatus for resistance training comprising a frame adjustably supporting a laterally extending platform at a plurality of vertical elevations, said platform supporting and locating a user for said resistance training, said platform having distally opposite first and second sides laterally spaced along a first lateral axis, said platform having distally opposite third and fourth sides laterally spaced along a second lateral axis, said first and second lateral axes being normal to each other, an adjustment mechanism raising and lowering said platform to said plurality of vertical elevations, said adjustment mechanism both:

a) journaling said platform to pivot about a pivot axis parallel to said first lateral axis into and out of engagement with a detent lock, such that said platform is locked in place at a given vertical elevation when pivoted into engagement with said detent lock, and said platform may move up and down when pivoted out of engagement with said detent lock; and b) linearly guiding translational movement of said platform during said up and down movement of said platform and preventing side to side canting of said platform about said second lateral axis during said up and down movement of said platform and preventing misalignment of said first and second sides of said platform, wherein:

said adjustment mechanism comprises first and second stanchions extending upwardly from said frame, each stanchion having a track extending upwardly and downwardly therealong and a tooth rack extending upwardly and downwardly therealong, and said platform has first and second bearing blocks pivotable about and translational along said stanchions;

said adjustment mechanism further comprises first and second guide rods extending upwardly from said frame adjacent said first and second stanchions, respectively, and first and second linear bearing assemblies slidable upwardly and downwardly along respective said first and second guide rods and operatively connected to respective said first and second bearing blocks to guide translational up and down movement of said first and second bearing blocks and prevent said canting of said platform about said second lateral axis;

said first bearing block has a horizontal first main shaft translational along said track of said first stanchion and moving upwardly and downwardly therealong during said up and down movement of said platform;

said second bearing block has a horizontal second main shaft translational along said track of said second stanchion and moving upwardly and downwardly therealong during said up and down movement of said platform;

said horizontal first and second main shafts are coaxial;

said platform is pivoted between first and second locked and unlocked positions by swinging said third side of said platform upwardly and downwardly to pivot said platform about said coaxial horizontal first and second main shafts;

said first bearing block has a horizontal first auxiliary shaft engaging a given first tooth in said tooth rack of said first stanchion in said first pivoted position of said platform to lock said platform at a given one of said vertical elevations corresponding to said given first tooth, said horizontal first auxiliary shaft disengaging said tooth rack of said first stanchion in said second pivoted position of said platform to unlock said platform and permit upward and downward movement thereof;

said second bearing block has a horizontal second auxiliary shaft engaging a given second tooth in said tooth rack of said second stanchion, corresponding to said given first tooth, in said first pivoted position of said platform to lock said platform at said given one of said vertical elevations corresponding to said given second tooth and said given first tooth, said horizontal second auxiliary shaft disengaging said tooth rack in said second pivoted position of said platform to unlock said platform and permit upward and downward movement thereof;

said first linear bearing assembly has a first bearing sub-block laterally adjacent said first stanchion;

said horizontal first main shaft has a first end mounted to said first bearing block, and has a second end mounted to said first bearing sub-block;

said first stanchion is disposed laterally between said first bearing block and said first bearing sub-block;

said second linear bearing assembly has a second bearing sub-block laterally adjacent said second stanchion;

said horizontal second main shaft has a first end mounted to said second bearing block, and has a second end mounted to said second bearing sub-block;

said second stanchion is disposed laterally between said second bearing block and said second bearing sub-block.

2. The exercise apparatus according to claim 1 wherein:

said first stanchion has a first slot formed laterally therethrough, said first slot being elongated upwardly and downwardly along said first stanchion and having opposing elongated inner sides facing each other across said first slot, one of said inner sides providing said track of said first stanchion, the other of said inner sides providing said tooth rack of said first stanchion;

said horizontal first main shaft extends laterally through said first slot;

said second stanchion has a second slot formed laterally therethrough, said second slot being elongated upwardly and downwardly along said second stanchion and having opposing elongated inner sides facing each other across said second slot, one of said inner sides of said second slot providing said track of said second stanchion, the other of said inner sides of said second slot providing said tooth rack of said second stanchion;

said horizontal second main shaft extends laterally through said second slot.

3. The exercise apparatus according to claim 1 wherein:

said horizontal first auxiliary shaft includes a first cam follower journaled thereto, and wherein said horizontal first auxiliary shaft engages said tooth rack of said first stanchion at said first cam follower;

said horizontal second auxiliary shaft includes a second cam follower journaled thereto, and wherein said horizontal second auxiliary shaft engages said tooth rack of said second stanchion at said second cam follower.

4. The exercise apparatus according to claim 1 wherein said platform is a stand-upon platform supporting the feet of the user.

5. The exercise apparatus according to claim 1 wherein said platform is a cantilever having a root end at said fourth side, and a free end at said third side.

* * * * *